US007204267B1

(12) United States Patent
Persico

(10) Patent No.: US 7,204,267 B1
(45) Date of Patent: Apr. 17, 2007

(54) MODULAR ROUGH-IN PLUMBING ACCESSARY

(75) Inventor: Charles Persico, Elk Grove, IL (US)

(73) Assignee: Kyne Industries, Inc., Palatine, IL (US)

( * ) Notice: Subject to any disclaimer, the term of this patent is extended or adjusted under 35 U.S.C. 154(b) by 0 days.

(21) Appl. No.: 11/344,736

(22) Filed: Feb. 2, 2006

(51) Int. Cl.
*F16L 5/00* (2006.01)

(52) U.S. Cl. ..... 137/360; 137/357; 312/229

(58) Field of Classification Search ..... 137/357, 137/360; 312/229
See application file for complete search history.

(56) References Cited

U.S. PATENT DOCUMENTS 4,564,249 A 1/1986 Logsdon
4,637,422 A 1/1987 Izzi
4,716,925 A 1/1988 Prather
4,942,896 A * 7/1990 Slusser ..... 137/360
5,253,670 A * 10/1993 Perrott ..... 137/247.25
5,261,444 A 11/1993 Childers, Jr.
5,423,345 A 6/1995 Condon
6,035,886 A 3/2000 Kerr
6,732,758 B2 5/2004 Kopp
2002/0134431 A1* 9/2002 Kopp ..... 137/360

* cited by examiner

*Primary Examiner*—A. Michael Chambers
(74) *Attorney, Agent, or Firm*—Charles F. Lind

(57) ABSTRACT

The modular plumbing accessary utilizes an open sided box secured during rough-in to and between exposed wall studs. A unitary water pipe and anti-hammer assembly is connected to the box with only an outlet pipe exposed in the box interior. The water inlet pipe and an anti-hammer assembly and its tee connection upstream of the outlet pipe are located outside of the box interior. A drain inlet is also exposed in the box interior. Rough-in connections are made between the building pipes and the respective water inlet and drain outlet pipes at the box. Further, a compression seal shutoff valve will be secured during rough-in to the water outlet pipe within the box interior. The open side of the box faces the sink, making line connections between the sink and the valve and drain inlet easy and reliable.

17 Claims, 3 Drawing Sheets

MODULAR ROUGH-IN PLUMBING ACCESSARY

BACKGROUND OF THE INVENTION

Residential buildings typically are fabricated by different trade groups along specific sequences. Thus, carpenters rough in walls, leaving exposed horizontally spaced vertical studs. Plumbers rough in water and drain piping, typically with vertical runs between adjacent studs and with capped end stubs projected several inches in front of the wall where a sink or water-using apparatus is to be mounted. This plumbing effort will commonly include the time-consuming fabrication from multiple elbows, pipes, end cap and tee components of an anti-knock compression assembly connected in each water line upstream of the end stub, for precluding hammer noises of water surging in the pipes as the sink valves are operated. Plasters then close the room side of the wall with wall panels or the like secured over the studs, fitting the capped pipe ends through openings cut in the wall to be exposed in the room. Carpenters will then install cabinets etc. as needed; and ultimately the sink will be installed proximate the stub ends, be it in the cabinet or free standing. The plumber will lastly finish connect the building pipe ends to the sink, by removing the end caps, connecting a stop angle valve on each open building pipe end, and running water and drain lines between the building valves and drain-outlet and the sink pipes and drain.

As each piping run between the adjacent wall studs extends approximately 2–8 foot upwardly from below the floor or downwardly from above the ceiling, it frequently is inadequately braced, making possible excessive pipe flexure as line or valve connections are initially made to the pipe or later removed and replaced by a new valve or the like.

Some alternative rough-in situations secure a box between and to adjacent studs that is open on one side toward the sink, with the vertical building pipe runs extending through openings in the box walls and terminating inside the box and being closed with an end cap or an angle stop valve connected thereto. The wall covering would not overlie the open box cavity, so that the pipe ends and/or valves remain exposed to the room interior. Finish connection can then be made between the sink lines and the exposed valves and drain. However, no anti-knock assembly piping would be used, or if used is in the box cavity to consume much of the overall box space (see U.S. Pat. No. 6,732,758 B2).

Should the stop angle valves be connected to the open water pipe stub ends during the plumbing rough in, instead of capping the pipe ends, the opening in the later added wall would have to be larger to fit over the valve, increasing clearance gaps around each pipe, which belie quality construction and might even could suggest potential access routes for insects or vermins between the wall and room interiors.

SUMMARY, FEATURES AND OBJECTS OF THE INVENTION

This invention teaches a modular piping accessary, and an object of this invention is to use this accessary for quickly, economically and reliably making rough-in plumbing connections between building pipes and the accessary, and allowing thereafter for easily making trim plumbing connections between the accessary water valves and drain fitting and a nearby sink.

More specifically, the inventive modular plumbing accessary allows for making plumbing rough-in connections of building water and/or drain pipes thereto, including the specific connection of an angle stop valve and unitary anti-knock water hammer assembly on each hot and/or cold water line.

This invention further includes a unitary anti-knock compression assembly having water inlet and outlet ends with an anti-knock compression assembly connected off an intermediate tee therebetween, the assembly including a closed end riser pipe in adjacent spaded parallel association with the water outlet end.

The plumbing accessary includes a box that will be connected to the exposed wall studs, and having a unitary anti-knock piping assembly installed thereto with an outlet line terminating inside of the box cavity suited to have a compression sealing valve fitted during rough-in thereon, and having the inlet end, the tee and the anti-knock compression assembly outside of the box with the anti-knock compression riser pipe and outlet line extended generally vertical and substantially parallel.

The invention further provides a drain fitting secured to the accessary box with an exposed inlet end therein, and with an outlet end outside of the box that can be rough-in connected to the building drain piping, allowing easy trim connection between a proximate sink drain and drain fitting inlet end.

The plumbing accessary box, when connected to and between adjacent exposed wall studs, will lie somewhat even with the front plane of the studs with the open box side facing where the sink to be located, and the unitary anti-knock compression assembly, angle stop valve and drain fitting will lie generally rearward of the front plane of the studs, making possible a subsequent installation of a wallboard having a cutout opening corresponding to the box, and an annular trim rim to be secured to overlie the wallboard opening and box edges.

BRIEF DESCRIPTION OF THE DRAWINGS

These and other objects, features or advantages of the invention will be more fully understood and appreciated after considering the following description of the invention, which includes the accompanying drawings, wherein.

DETAILED DESCRIPTION OF THE INVENTION

Figure 7:
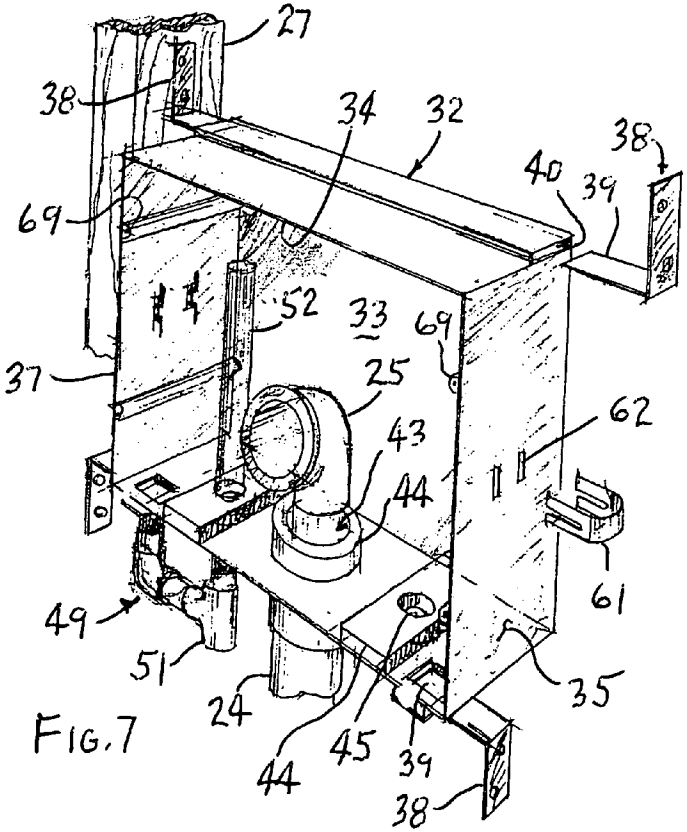
FIG. 7 is a frontal perspective view of the modular assembly box similar to FIG. 2, except being viewed from the opposite side and with several of the components not yet installed therein.
Figure 5:
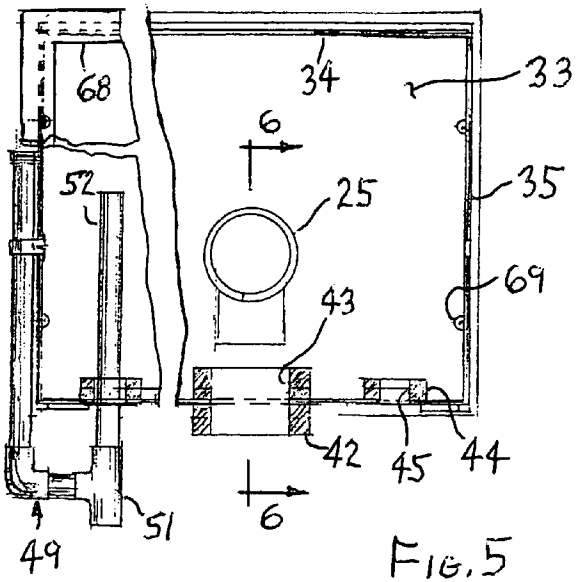
FIG. 5 is a front elevational view of the modular assembly box, shown in three different viewing manners: (1) with only the assembly box being illustrated on the right of the figure; (2) with the assembly box and anti-knock compression assembly mounted together being illustrated on the lower left of the figure; and (3) with the modular assembly box and finished wall being illustrated on the upper left of the figure.
Figure 1:
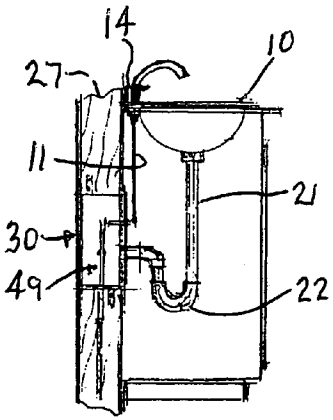
FIG. 1 is an elevational view of a cabinet mounted sink, showing drain and water lines leading between the sink and the modular plumbing accessary box mounted in an adjacent wall.

FIG. 1 illustrates a conventional counter mounted sink 10, having water and drain connections made according to this invention. Thus, hot and cold water lines 11, 12 (FIG. 2) are extended between the sink faucet assembly 14 and building hot and cold stop angle valves 15, 16 off of the building hot and cold water pipes 17, 18; the valves and water pipes being recessed in the wall 20. Also, the sink drain is connected via the line 21 and J-trap 22 with the building drain pipe 24 and drain fitting 25; the pipe and fitting also being recessed in the wall.

Figure 2:
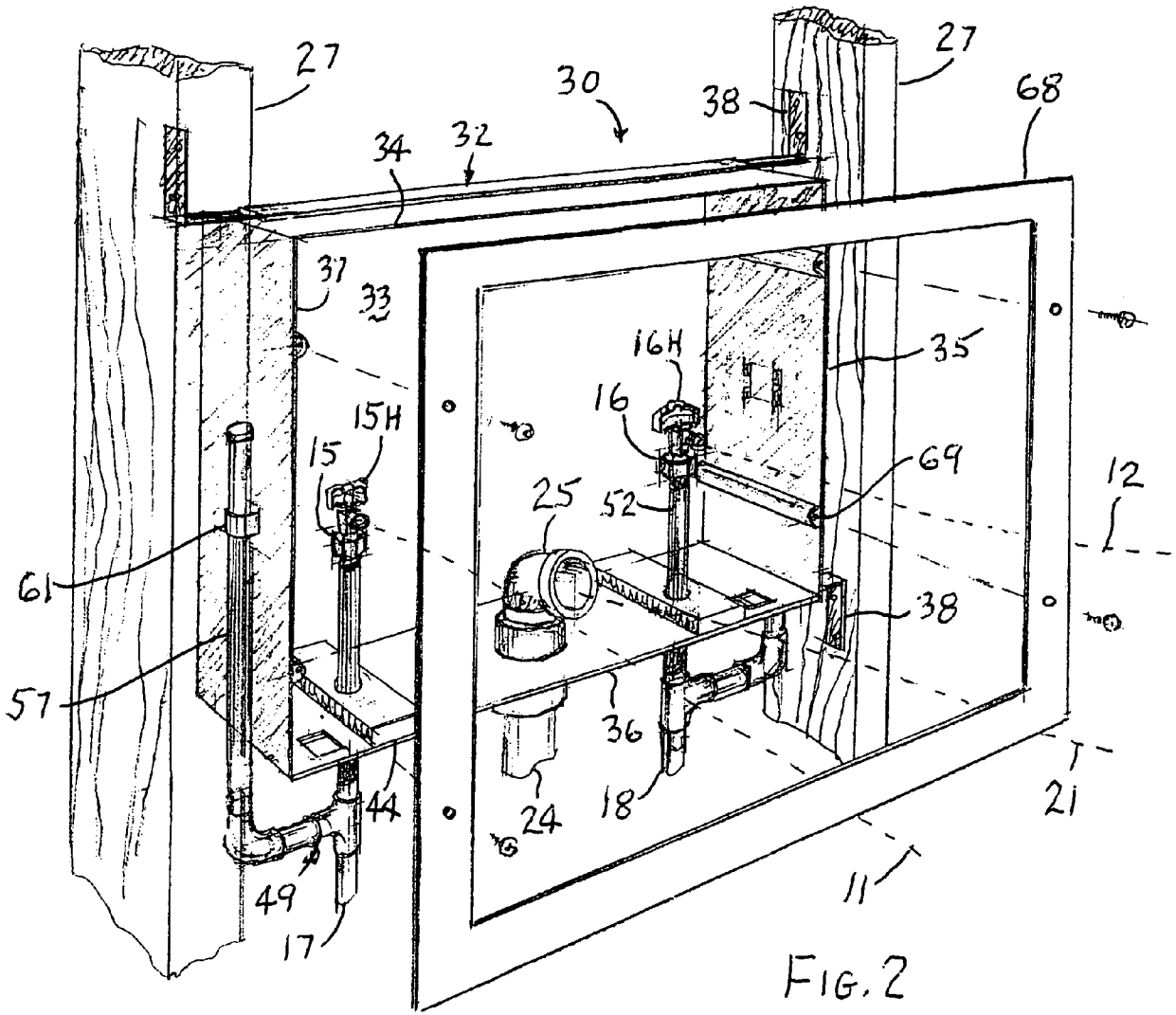
FIG. 2 is a frontal perspective view of the modular assembly box mounted between adjacent building studs and with building water and drain pipes connected thereto, with water stop valves and a drain fitting mounted in place ready for trim connection with the sink water and drain lines, and with a trim plate shown in exploded association therewith prior to its trim installation.
Figure 4:
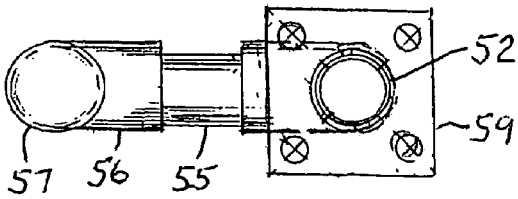
FIG. 4 is a top view of the unitary compression assembly of FIG. 3, without showing the accessory box.
Figure 3:
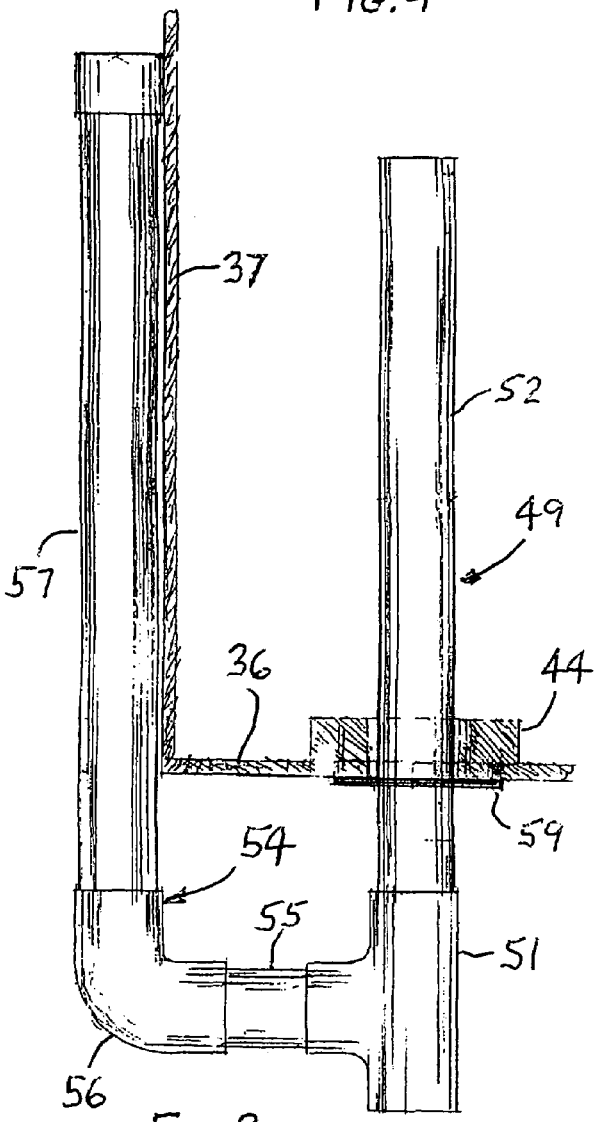
FIG. 3 is a front elevational view of the unitary anti-knock compression assembly, shown mounted in the accessory box of FIGS. 1 and 2.

FIG. 2 illustrates the building wall 20 in rough-in condition with the horizontally spaced vertically extended studs 27 yet exposed and uncovered. The illustrated building hot and cold water pipes 17, 18 and building drain pipe 24 run between the studs 27, rising vertically upward from below the underlying building floor (not shown). The modular plumbing accessary 30 is secured by the plumber, during the piping rough-in phase, to and between the wall studs 27 where the building water pipes 17, 18 and building drain pipe 24 are to be run so as to be proximate the sink 10.

The modular plumbing accessory 30 includes an open sided box or housing 32 having a rear wall 33 and peripheral side walls 34, 35, 36, 37 extended forwardly therefrom. Four L-shaped brackets 38 secure the accessary box 32 to and between adjacent studs, one leg 39 of each bracket being constrained to slide laterally within housing channels 40 formed on the upper and lower box walls 34, 36 while the other leg butts against and is secured by screws to the adjacent stud 27. Lower box wall 36 has a central boss area 42 slightly spaced inwardly from the adjacent side wall and spaced side boss areas 44, and an opening 43 and 45 is provided respectively within each boss area, suited to respectively receive and hold drain fitting 25 and the hot and cold water pipe assemblies 49.

Each water pipe assembly 49 is unitary or preformed with a tee 51 having three branch openings, with an outlet pipe 52 sealed in one opening and an anti-knock or water hammer compression assembly 54 sealed in an intermediate tee opening. The illustrated anti-knock assembly 54 is formed from nipple 55, elbow 56 and riser pipe 57 sealed together, with the remote end of pipe 57 being closed by cap 58; however, it could be formed as a one-piece casting or by bending and capping a single pipe to a similar configuration.

The upper outlet end pipe 52 of each pipe assembly 49 is sized to fit snugly through the boss area opening 45 until a mounting plate 59, secured on the mid portion of the pipe 52, butts against the housing 32; whereupon the plate can be secured to the boss area 44, by self-tapping screws or the like. When so mounted, the outlet pipe 52 will be spaced from the adjacent side 35 or 37, upper 34 and rear 33 box walls, and will terminate within the interior cavity of the housing or box 32.

The outlet end pipe 52 and riser pipe 57 extend substantially parallel to one another, spaced apart to provide that when the piping assembly 49 is mounted on the housing 32, the riser pipe 57 will be outside of the housing and closely adjacent the side wall 35 or 37. A U-shaped barbed clip 61 sized to overlie the pipe 57 and be snapped into the adjacent box wall openings 62 can be used to firmly secure the pipe 57 of the assembly 49 relative to the housing or box 32.

The two pipe assemblies 49 and the box 32 can be shipped assembled as illustrated, or as separate components to be assembled and secured together on site.

The installing plumber can mount the box 32, with pipe assemblies 49 secured thereto, between the wall studs 27. The anti-hammer pipe assembly 54 and tee 51 will be outside of the box, with the closed end pipe 57 aligned to be substantially vertical as would the outlet water pipe 52 be within the box. The box width across walls 35, 37 might be possibly 8–12 inches, to fit with side clearance between the spaced studs 27 on conventional 16" centers. Also, the box depth or thickness might be less than possibly 4", so that the rear wall can lie generally on or slightly forward of the rear faces of its adjacent studs 27, whereby the front edges of the peripheral walls 34, 35, 36, 37 will project only slightly forwardly of a plane extended through the front faces of the adjacent studs. As so mounted, the box interior or cavity will be open toward the adjacent room and the planned sink 10.

The height of the brackets can be set to where needed for making subsequent connections to the planned nearby sink, and the ample length of the bracket legs 39 will allow some side-to-side adjustment of the box between the adjacent studs. When the box is so mounted, the building water pipes 17, 18 can be sealed to the third branch opening of tees 51; and the building drain pipe 24 can be connected relative to the central box boss opening 43, and the drain fitting 25 sealed thereto. The drain pipe 24 typically will be structurally stiff, which will further restrict or prevent any significant box movement relative to the studs.

This invention allows and anticipates that the shut off angle stop valves 15, 16 will be connected to the upper ends of outlet end pipes 52 during the plumbing rough-in phase. Many plumbers prefer to use compression fit sealing valves, as each valve can be sealed on the outlet pipe simply by tightening a nut threaded on the valve. Each valve 15, 16 has a handle 15H, 16H for manually opening or closing the valve. With valves 15, 16 sealed on the piping assemblies 49 and closed, the sink rough-in plumbing might be considered complete, and the building piping could be pressurized to test for plumbing leaks.

Figure 6:
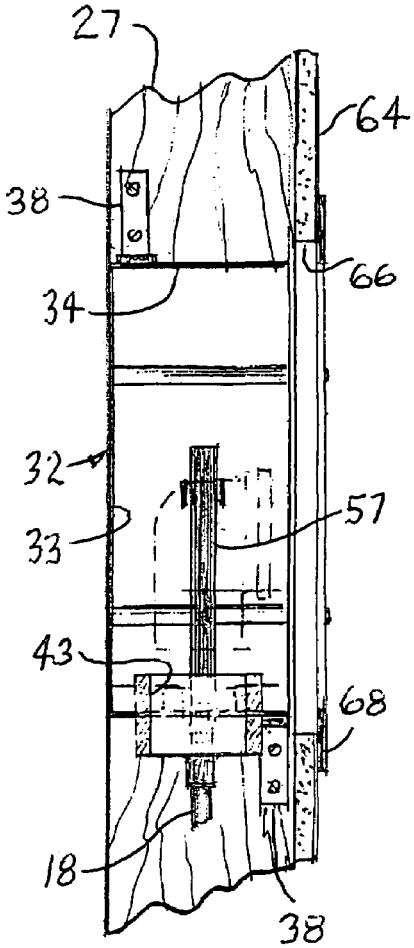
FIG. 6 is a sectional view from line 6—6 in FIG. 5, except of the complete modular assembly box mounted in the wall.

The wall panels or covering 64 (FIG. 6) will have a cut out opening 66 larger than and surrounding the box side walls 34, 35, 36, 37, with an annular clearance gap therebetween. An annular trim plate 68 will be provided as part of this accessory to be secured to the box by screws or the like threaded into side wall boss openings 69 (FIG. 2), to overlap and cover this gap. As this cannot be done until the wall has been closed, the plumber preferably would keep the trim plate to connect it when he returns for the finish work effort.

Each shutoff valve 15, 16 would have a threaded outlet to which the water lines 11, 12 leading to the sink faucets can be connected. Further, the water shutoff valves 15, 16 and drain fitting 25 supported within the box cavity would open toward the intended sink, for allowing the easy connection thereto of the sink water lines 11, 12 and drain line 21. The water lines 11, 12 could be formed of rigid or flexible tubing, fittings etc. as desired or as needed to comply with local building codes. The valves 15, 16 would remain closed until the sink water and drain lines had been connected, and would be opened when the sink was to be functional.

When the sink is totally connected, the outlet pipes 52 and shutoff valves 15,16 will be in the box cavity recessed in the wall, and the water and drain lines 11, 12 and 21, 22 will be outside of the box, yielding a neat and uncluttered look.

The accessary box 32 can be formed of injected molded plastic, with solid back and peripheral walls 33, 34, 35, 36, 37 except for the boss areas openings 43, 45 for the drain and water pipes, and the retaining clip openings 62.

After reviewing this disclosure, one might resolve that the same teachings could be altered and/or used in different manners or modes, without departing from the essence of this invention. Accordingly, the invention is to be limited not by the specification but only by the following claims.

What is claimed is:

1. A modular accessary for completing rough-in plumbing connections of a building water pipe located between adjacent uncovered wall studs, suited for making later trim connections between the accessory and a nearby water-using appliance, comprising the combination of an open sided box having a rear wall and peripheral side walls;

a unitary water pipe assembly having a tee with three branch openings, an anti-hammer compression pipe sealed off one branch opening and an outlet pipe sealed off another branch opening, said outlet pipe being sized to fit through an opening in one of the box side walls and terminate within the box with clearance from the box walls and with said tee and anti-hammer pipe then being outside of the box, and means for securing the pipe assembly to said box in this orientation;

means to secure the box to and between adjacent studs with the rear wall generally aligned between adjacent studs, with the box being open toward the intended appliance location, and with the anti-hammer pipe being aligned substantially upward; and means to connect the building water pipe to the remaining tee branch opening outside of the box.

2. A modular rough-in plumbing accessary according to claim 1, further comprising a shutoff valve sealed on the outlet pipe and exposed within the box during building water rough in.

3. A modular rough-in plumbing accessary according to claim 2, further comprising said shutoff valve being a compression fit sealing valve.

4. A modular rough-in plumbing accessary according to claim 2, further comprising said means for securing the housing to adjacent studs includes L-brackets each secured by one leg to an adjacent stud and by the other bracket leg aligned transverse to the studs and cooperating adjustably with box side wall channels.

5. A modular rough-in plumbing accessary according to claim 4, further comprising said means for securing the water pipe to a box side wall including a bracket secured to the outlet pipe, and means to secured the bracket to said one box side wall.

6. A modular rough-in plumbing accessary according to claim 5, further comprising the means for securing the water pipe to said box side walls including a clip overlying the anti-hammer pipe and interlocking with and adjacent box side wall via its insertion into openings in said adjacent box side wall.

7. A modular rough-in plumbing accessary according to claim 6, further comprising said shutoff valve being a compression fit sealing valve.

8. A modular rough-in plumbing accessary according to claim 6, further comprising an annular trim piece sized to overlap the adjacent wall and adjacent edges of the box side walls while leaving the remainder of the box open and exposed.

9. A modular accessary for completing rough-in plumbing connections of building water and drain pipes located between adjacent uncovered wall studs, suited later for ready trim connections between the accessory and a nearby water-using appliance, comprising the combination of an open sided box having a rear wall and peripheral side walls;

a unitary water pipe assembly having a tee with three branch openings, an anti-hammer compression pipe sealed off one branch opening and an outlet pipe sealed off another branch opening, said outlet pipe being sized to fit through an opening in one of the box side walls and terminate within the box with clearance from the box walls, with said tee and anti-hammer pipe then being outside of the box, and means for securing the pipe assembly to said box in this orientation;

means to secure the box to and between adjacent studs with the rear wall generally aligned between adjacent studs, with the box being open toward the intended appliance location, and with the anti-hammer pipe being aligned substantially upward;

means to connect the building water pipe to the remaining tee branch opening outside of the box;

a tubular drain fitting sized to be inserted through an opening in one of the box side walls and terminate within the box at an inlet end spaced from the box walls and to terminate outside of the box at an outlet end; and means to connect the building drain pipe to the drain fitting outlet end.

10. A modular rough-in plumbing accessary according to claim 9, further comprising a shutoff valve sealed on the outlet pipe and exposed within the box during building water rough in.

11. A modular rough-in plumbing accessary according to claim 10, further comprising said shutoff valve being a compression fit sealing valve.

12. A modular rough-in plumbing accessary according to claim 10, further comprising said means for securing the housing to adjacent studs includes L-brackets each secured by one leg to an adjacent stud and by the other bracket leg aligned transverse to the studs and cooperating adjustably with box side wall channels.

13. A modular rough-in plumbing accessary according to claim 12, further comprising said means for securing the water pipe to a box side wall including a bracket secured to the outlet pipe, and means to secured the bracket to said one box side wall.

14. A modular rough-in plumbing accessary according to claim 13, further comprising the means for securing the water pipe to said box side walls including a clip overlying the anti-hammer pipe and interlocking with and adjacent box side wall via its insertion into openings in said adjacent box side wall.

15. A modular rough-in plumbing accessary according to claim 14, further comprising said shutoff valve being a compression fit sealing valve.

16. A modular rough-in plumbing accessary according to claim 15, further comprising an annular trim piece sized to overlap the adjacent wall and adjacent edges of the box side walls while leaving the remainder of the box open and exposed.

17. A modular rough-in plumbing accessary according to claim 15, further comprising whereby after the studs have been covered while leaving the box open and exposed and after the water-using appliance has been mounted where intended, a water line can be trim connected between the exposed shutoff valve and the appliance to complete the water connection to the appliance and a drain line can be trim connected between the appliance and the drain fitting inlet end within the box.

* * * * *